US007265735B2

(12) United States Patent
Ilyanok

(10) Patent No.: US 7,265,735 B2
(45) Date of Patent: Sep. 4, 2007

(54) SELF SCANNING FLAT DISPLAY

(76) Inventor: Alexandr Mikhailovich Ilyanok, Zhukovsky Street, 10-1-72, Minsk, 220007 Belarus (BY)

( * ) Notice: Subject to any disclaimer, the term of this patent is extended or adjusted under 35 U.S.C. 154(b) by 456 days.

(21) Appl. No.: 10/482,349

(22) PCT Filed: Mar. 1, 2002

(86) PCT No.: PCT/EA02/00008

§ 371 (c)(1),
(2), (4) Date: Aug. 13, 2004

(87) PCT Pub. No.: WO03/003335

PCT Pub. Date: Jan. 9, 2003

(65) Prior Publication Data

US 2004/0257302 A1 Dec. 23, 2004

(30) Foreign Application Priority Data

Jun. 29, 2001 (EA) ..... 200100786

(51) Int. Cl.
*G09G 3/00* (2006.01)
*G09G 5/00* (2006.01)

(52) U.S. Cl. ..... 345/55; 345/30

(58) Field of Classification Search ..... 345/30–100
See application file for complete search history.

(56) References Cited

U.S. PATENT DOCUMENTS 3,882,342 A * 5/1975 Kamegaya et al. ..... 313/585
4,697,224 A 9/1987 Watanabe et al.
4,744,640 A * 5/1988 Phillips ..... 359/254
5,018,180 A 5/1991 Shoulders
5,300,272 A 4/1994 Simandl et al.
5,389,567 A 2/1995 Acovic et al.
5,420,746 A 5/1995 Smith
5,451,977 A * 9/1995 Kusuda et al. ..... 345/82
5,461,397 A * 10/1995 Zhang et al. ..... 345/66
5,557,497 A 9/1996 Ivanov et al.
5,667,637 A 9/1997 Jewell et al.
5,814,841 A * 9/1998 Kusuda et al. ..... 257/113
5,856,907 A 1/1999 Gabbai
5,866,975 A * 2/1999 Gartner et al. ..... 313/346 DC
6,037,104 A * 3/2000 Lahaug ..... 430/314
6,180,252 B1 1/2001 Farrell et al.
6,509,886 B2 * 1/2003 Ohno ..... 345/82
6,570,224 B1 * 5/2003 Ilyanok ..... 257/350
2002/0158342 A1 * 10/2002 Tuominen et al. ..... 257/784
2002/0192441 A1 * 12/2002 Kalkan et al. ..... 428/209

(Continued)

*Primary Examiner*—David L. Lewis
(74) *Attorney, Agent, or Firm*—Brooks Kushman P.C.

(57) ABSTRACT

A self-scanning flat display having a light active matrix in the form of a set of periodic lines which include light-reflecting, light-transparent, or light-emitting elements. These elements are controlled by current or a charge generated by a scan raster device. The raster device is made in the form of a streamers produced from nanostructured active material, in which there is induced and propagates a soliton, i.e., a maintained running electronic wave. The soliton controls the light active matrix. The nanostructured material includes clusters with tunnel-transparent coatings. The clusters have the sizes, at which the resonant features of the electron are manifested. The sizes are determined by the circular radius of the electron wave. The cluster size is set within the range $r_0$-$4r_0$, i.e., 7.2517 nm$\leqq$r$\leqq$29.0068 nm. The width of the tunnel-transparent gap is not more than $r_0$=7.2517 nm.

20 Claims, 2 Drawing Sheets

U.S. PATENT DOCUMENTS

2003/0058386 A1* 3/2003 Bastiaansen et al. ..... 349/100
2005/0068805 A1 3/2005 Ilyanok
2005/0128562 A1* 6/2005 Fitzmaurice et al. ..... 359/265
2006/0097302 A1 5/2006 Ilyanok

* cited by examiner

SELF SCANNING FLAT DISPLAY

BACKGROUND OF THE INVENTION

1. Field of the Invention

The present invention relates to the field of electronic and informatics and can be used in the production of color displays for computers and television (TV) sets having a screen area up to one square meter (m), and also for possible information systems in which the screen area considerably exceeds one square meter.

2. Background Art

The development of high-quality, wide-screen, flat panel displays (FPD) which currently account for more than half of the unit's production cost is the major challenge for the emerging high-tech household and industrial markets offering high definition televisions (HDTV), personal computers (PC), and electronic books.

Flat display types currently available include color and black-and-white liquid crystal displays (LCD) and wide screen color plasma display panels (PDP). LCDs, however, are relatively small, highly dependent on the angle of observation, and hard to operate. PDPs, in turn, consume much energy per unit of space, have intricate matrix high-voltage electronic controls, and emit high levels of electromagnetic radiation. Both displays are prohibitively expensive and cannot so far be produced on a regular basis to supplant the cathode ray tube (CRT).

Competing technologies such as field emission displays (FED), electro-luminescent displays (ELD), and light-emitting diodes (LED) have yet to be commercially available [1].

Recent hopes are tied to using polymer materials for flat panel displays. Organic materials such as PPV, DPVBi, etc., are considered good for producing low-cost, flexible plastic light-diode large-size panels. A great amount of effort is being made to develop polymer-based LCDs. None of these are commercially available, however.

Recent years have seen, besides the above technologies, a brand new one based on electronic clusters (EC) as disclosed in U.S. Pat. No. 5,018,180 issued to K. R. Shoulders [2]. A good case in point here is a newly developed matrix-controlled 2000*2000 PGB pixel resolution display. This technology eliminates the weaknesses of FED and PDP and achieves a high electric-to-light energy conversion ratio within an area of about one square meter wide and one cm thick.

The intermediate size displays can be carried out on the basis of magnetic or electrostatic balls in which one hemisphere is painted. They are usually apply for the creation of the static image, so-called electronic paper (EP).

The spherical particles have two areas: reflecting and black. These balls turn in a magnetic or electrostatic field created by two conductors with matrix x-y addressing. The degree of the turn of the balls defines the grey scale. After field removal, the balls keep the last orientation for an indefinite period of time. The time of turning on is about 30 ms. It is supposed that the power of dispersion is small. The technology can appear rather perspective for the creation of electronic magazines in the future. But it is not very promising in making PCs and TVs because of a matrix control system of rotation and low speed.

The display types available are either light-emitting or external light controlling. The latter are divided into light-reflecting, light-transparent, and light-absorbing.

An important problem of fatigue contributor to reconfiguration with is display flickering with the standard 50/60 Hz frame rotation frequency. Invisible to the eye, it synchronizes the α-rhythms of the human brain making the latter behave unnaturally. This in its turn tires the user dramatically. The situation can be avoided by increasing the display operation and respectively bringing the frame rotation frequency up to 75 Hz or more [1].

One should also take into account the user's fatigue resulting from the display's electromagnetic radiation. Moreover, prolonged exposure may affect general health.

Ways of image formation, or addressing, have a direct influence on the display's specifications. The two main approaches are based on either a movable radiation source (a driver) or an immovable radiation source. In the former case, radiation is generated by a limited number of drivers (one to three) providing for successive frame rotation along x-y coordinates out of z coordinate perpendicular to them, like in CRT.

In the latter case, the sources of radiation are created by an orthogonal matrix right in the electrode crossings along x-y coordinates and scanned by way of appropriate switching of numerous control buses. Here, the amount of control buses is proportional to the square root of the number of image scanning points, i.e., about 2,000 or more.

There is also a combined rotation version, with the driver moving along the display surface with the assistance of a few special control electrodes. This approach to addressing is the most efficient from the control point of view. However, it is good for image creation only in special plasma displays through self-scanning (SS) of the gas discharge along the lines. This eliminates the need to use numerous high-voltage controls along x-y element buses, making the whole setup easier to manage and reducing power consumption and electromagnetic radiation from the display.

The combined version, despite its advantages, has so far failed to work for other types of displays.

From the analysis follows that development of cheap, large-size flat displays with low level of electromagnetic fields and high frame rotation frequency continues to be rather urgent.

SUMMARY OF THE INVENTION

It is common knowledge that drivers responsible for the rotation in FPD account for nearly 50% of the display cost. Drivers used in light-controlling displays consume most of the power and create main spurious electromagnetic fields.

Self-scanning, as the inventor sees it, is the only way to bring down the driver cost, make the drivers more reliable, and reduce their spurious electromagnetic radiation. It can be performed by an electric current source in the way of a moving electronic cluster (EC).

The task of achieving self-scanning image rotation was seriously challenged by one theoretical limitation related to S. Earnshaw's electrostatics theorem according to which the system of reposing point charges located at a final interval from each other cannot be stable.

However, the charges could still form a stable cluster—without changing the theorem's requirements—at certain movement speeds, under certain geometric conditions, and in certain materials.

The large quantity of experiments confirms that clusters having the size of one micron can be formed in vacuum at explosive emission of electrons from metal [3]. Electronic clusters by the size 10-50 microns form at emission of electrons from a metal needle on a surface of dielectric.

Some researchers in the U.S. moving along similar lines include T. H. Bayer (1970), R. L. Forward (1984), K. R. Shoulders (1991), and others [2].

The research, carried out by them, have shown that cluster degrades during movement along a dielectric surface. Therefore, there was a necessity of getting steady electronic cluster (EC) as applied for the display and optimizing the following conditions:

EC charge self-scanning;

EC movement control in solids and in vacuum with no charge loss; and

EC electronic package pulse emission into vacuum.

The above theoretical and experimental investigations made it possible to develop the ways of calculating geometrical and physical parameters of the devices under consideration.

The essence of the invention is the creation of low-cost flat displays of the large-size format with a reduced level of electromagnetic fields and high frame rotation frequency.

In the disclosed invention for the creation of the self-scanring flat display it is required to develop a material, from which there is a cold emission electrons and the movement electronic cluster along a surface is simultaneously carried out.

For this purpose it is proposed to use the new mechanism of electron movement in dielectric and semiconductors in view of the spatial structure of an electron wave, published in the PCT Application [4].

In this work is shown, that the electron form—its charging wave, changes depending on speed of electron movement and structure of a material in which it goes. In the simplest cases, the electron form can be presented as charged tore rotating about an axis [5]. Electron in a minimum of the energy is possible to be presented as a thin uniformly charged ring with a charge q, rotating about the axis with speed $\alpha^2c$, where $\alpha$—constant of fine thin structure, and c—speed of light. The electrostatic field of such an electron is concentrated in its plane, i.e., it represents the transverse charged wave. In result, the section of interaction between such electrons is minimal. It is possible to observe such electron state in vacuum at its movement with speed relatively laboratory system of coordinates, less $\alpha^2c$ or at its movement in superconductors or thin dielectric films on a surface of the semiconductor at low temperatures (quantum effect of Hall) [4]. The diameter of such an electron is determined from experiment on electron "tunneling" through a vacuum interval. It Is experimentally established, that the tunnel effect disappears at a distance between electrodes of about 8 nm [6, chapter 3]. This extremely important experimental fact is constantly ignored.

Nevertheless it is possible to determine this size theoretically too. Consider that the radius of such ring electron is connected with fundamental constants [4]:

$$r_0=\hbar/(m_e\alpha^2c)=7.2517 \text{ nm}. \quad (1)$$

The proposed theoretical model of a ring electron gives a new approach in describing most of the time-varying and non-linear processes occurring in condensed matter with new position.

In certain materials it is possible to induce a condition of formation of a ring electron by means of an external action and/or by nanostructuring of a matter. By that, the resonance conditions of operating of nanoelectronic devices are provided which allow their functioning at normal and higher temperatures.

Due to reduction of interaction cross-section with ions of a dielectric crystal lattice it is possible to increase the working temperature up to $$T_e=m_e\alpha^3c^2/2\text{ k}=1151.86 \text{ K}(878.71^\circ \text{ C.}). \quad (2)$$

The transition potential of an electron through a barrier Ue=0.09928 V corresponds to this temperature. At coupling of electrons with the unidirectional spins, their energy grows twice.

If electrons with oppositely directed spins couple, the coupling energy, due to the spin turning in space on $\pi$, decreases up to value $$T_\Pi=T_e/\pi=366.65 \text{ K}(93.5^\circ \text{ C.}). \quad (3)$$

Temperatures $T_e$ and $T_\Pi$ are critical working temperatures depending on the given mode of operations.

The frequency of rotation of an electronic ring determines the limiting working frequency $$f_e=\alpha^2c/2\pi r_0=m_e(\alpha^2c)^2/h=3.5037*10^{11} \text{ Hz}. \quad (4)$$

Extreme achievable density of a current is $$j_e=ef_e/\pi r_0^2=4\pi em_e^3\alpha^8c^4/h^3=3.4*10^4 \text{ A/cm}^2. \quad (5)$$

Maximum allowed field strength, at which disruption occurs is $$E_e=U_e/r_0=m_e^2\alpha^5c^3/2e\hbar=1.37*10^5 \text{ V/cm} \quad (6)$$

Ring electrons in superconductors, materials with phase transition the metal—semiconductor and special way nanostructured materials may pair into chains of two kinds: with parallel spin and anti-parallel spin states. The speed of movement of such chains in space is $\alpha^2c$ [4]. If the impulse of movement of the chain is directed perpendicularly along surfaces of a material, the part of electrons of the chain pass to vacuum. Such coherent effect of electron movement practically allows to overcome a barrier work function of electron to vacuum. Experimentally this effect was observed at field-emission of electrons from pins made from different superconductors [7]. In the work was shown, that electrons at a temperature of 300K pass in vacuum as $1e^-$, $2e^-$, $3e^-$, $4e^-$ . . . It is possible to make some analogy for coherent electronic effects with the movement of a long train of cars from a hill. The hill of greater height, but smaller length on the way of such system being raised, the whole train or a part of it are able to overcome this hill in dependence on this and the previous hills height ratio.

It is known, that the minimum of energy in the medium with self-action results only on the tore [5]. The electronic chain turned off in the tore under exit on a surface due to it is medium with self-action. The part of this chain remains in the material. Actually this chain creates an electronic cluster which partially is in medium and partially on a surface. It is important that the total charge of the cluster is quantized. Under action of the applied external field the part of an electron from the cluster can pass to vacuum in the direction of the anode. In this case the role of the anode carries out the screen of the display. As the charge of the cluster is quantized, it is restored by electrons from a substrate. The cluster could be made to move along a substrate synchronously with clock pulses which form line rotation of the display. For this purpose it is necessary to put on a substrate extended electrodes and to give on them the definite voltage which selects out from the under mentioned conditions.

It is necessary to develop for the display, as a movable driver, of a stable electronic cluster, from $10^{10}$-$10^{11}$ electrons of 30-100 μm in diameter right inside the nanostructured material. Such a cluster can generate an average current of 10-100 mA all along the length of the frame rotation.

Then it is needed to use the movable electronic cluster (one or three) as an RGB display control element in the self-scan mode. It will travel along a nanostructured coating placed on a dielectric substrate. By our experimental data the rate of it movement is $\leqq 2*10^5$ m/s. This velocity is 10 times greater than the rate of movement of a ray along the line in an electron tube and at a pace high enough to increase the frame frequency to 120 Hz. The substrate will also harbor control electrodes forming an unbroken serpentine line allowing streamer rotation. This will bring down the number of control electrodes from 1280×1024 in the HDTV standard to just fifteen making the electronic control unit much simpler and less expensive and lowering the level of the display's electromagnetic radiation, as the anode accelerating voltage is in a range 0.5-1.5 kV, that is substantially lower as compared with the usual CRT.

Changing the potentials on the control electrodes controls the rate of the electronic cluster traveling along the nanostructured coating. At the same time the addition of more electrodes can modify the total amount of the cluster charge or the current going through it which simplifies image formation.

The electronic cluster can travel in two ways. One way allows the movement within the coating itself. When making contact with a light active environment it can control the brightness of electro-luminescent materials such as in ELD or change the reflecting/absorbing properties such as in LCD. In the other option, the electronic cluster breaks down into two parts, with one still moving within the coating while the other emitting into gas or vacuum. In the latter case, the cloud of free electrons can excite luminofors the way it happens in PDP at the emission into gas, or in the vacuum FED.

The invention is directed to a display featuring simplified streamer rotation with self-scanning. Moreover, self-scanning can be rather easily synchronized through an external control signal.

The main disadvantage of the streamer rotation currently in use is a frame and line rotation standard mismatch with the prevailing TV and PC standards, requiring a standard matching device. Digital matching presents no problem while analog would have to keep in memory the rotation line, which would make TV sets a bit more complicated.

Self-scanning can also be utilized in available light-emitting displays, as the current level of the traveling source is high enough to excite low-voltage (about 1000 V) luminophors, light-emitting diodes, etc.

The essence of the invention is as follows.

In accordance with one embodiment of the invention, a self-scanning flat two-coordinate display, hereinafter referred to as a "display" includes a light active matrix in the form of a set of periodic lines which include light-reflecting, light-transparent, or light-emitting elements. The elements are controlled by current or a charge generated by a scan raster device. The raster device is made in the form of streamers from nanostructured active material, in which there is induced and propagates a running electronic wave (soliton). The running electronic wave controls the light active matrix.

The raster device may be made in the form of a matrix of isolated streamers. The streamers are produced from nanostructured active material overcoated by the lines in grooves on a surface of dielectric, with a step determined required resolution.

The raster device may be made in the form of at least one zigzag line—serpentine. The serpentine line is produced from nanostructured active material over-coated in the zigzag groove on a surface of dielectric, with a step determined required resolution.

For making raster in display on each streamer, produced from nanostructured active material, at least two control electrodes which determine parameters of soliton movement are overcoated. In the input of each streamer produced from nanostructured active material at least one control electrode is overcoated. This electrode forms the soliton of the given size in necessary time.

For contrast image acquisition between the raster device and the light active matrix, isolated from them it is formed at least one additional managing electrode. It is produced in the form of a grid, carrying out modulation of an electronic flow for formation of the image on brightness.

A source of electrons, simultaneously carrying out a role of the raster device is made from a strip nanostructured active material. This material includes clusters with a tunnel-transparent gaps, characterized in that the clusters have at least one distinguished cross-size, determined within the range from the $r=a*r_0$, where $r_0$ is determined as ring radius of an electron wave according to the formula $$r_0=\hbar/(m_e\alpha^2c)=7.2517 \text{ nm},$$

where $\hbar$—Plank constant, $m_e$—electron mass, $\alpha=1/137{,}036$—constant of fine structure, c—speed of light, and a—factor determined within the range $1\leqq a\leqq 4$. The thickness of the tunnel-transparent gap are not more than $r_0$, and the spacing between the electrodes is greater than $r_0$.

In the invention, the clusters could be made from material selected from the group consisting of the substances—semiconductor, conductor, superconductor, high molecular organic substance or their combination.

Also, the clusters could be made in the form of a cavity having a shell of a tunnel-transparent layer, consisting of the semiconductor or dielectric.

The clusters can have a centrally symmetric form or be extended and have a distinguished cross-sectional size determined from the formula $d=b*r_0$, where $2\leqq b\leqq 4$.

If the clusters are made extended along an axis, they can have a regular periodic structure with the period determined from the formula $\tau=b*r_0$, where $1\leqq b\leqq 4$.

According to another embodiment of the invention, a plurality of clusters can be periodically located at least in one layer, the intervals between clusters being tunnel-transparent not exceeding $r_0$.

Besides a plurality of clusters with tunnel-transparent gaps can be periodically located as layers, at least, in one of layers the parameters of the clusters can differ from the parameters of the clusters in the next layers. The intervals between are tunnel-transparent not exceeding $r_0$.

Also a plurality of clusters making in the form of a cavity having a shell made of a tunnel-transparent layer can contact at least in two points of a cavity with the next clusters. Then they form the material similar to foam with open pores. The shell is made from either semiconductor, dielectric, or high molecular organic substance, and the pores can be filled with either gas, semiconductor, or dielectric, with the properties differing from the properties of the material of the shell.

For the correct process of operating the display it is necessary to make definite requirements. Thus, the field strength on one cluster for work of the raster device should not be less than $E_{min}=m_e^2\alpha^5c^3/2e\hbar=1.37*10^5$ V/cm, and the maximal field strength should not exceed $3E_{min}$.

That the display has not left working modes, limiting working current density of the raster device is necessary to limit by value $j_e=4\pi em_e^3\alpha^8c^4/h^3=3.4*10^4$ A/cm$^2$.

For formation of one picture area it is necessary to give at least one managing impulse on an electrode of soliton formation and at least one more managing impulse on each electrode, managing soliton movement along lines.

After ending of soliton movement on a line, on each electrode of soliton formation is given at least one impulse for regeneration of nanostructured active material—it is made ready for the next picture area.

For formation of the contrast image it is necessary at least one additional managing electrode making as a grid, to give a impulse voltage, sufficient for extracting electrons in vacuum or on rarefied gaseous medium from the nanostructured active material. The amplitude of a managing impulse is proportional to the brightness of the image in the given point at the moment of passage of the soliton at this time. That way spatial time modulation of brightness is carried out due to management of a current or charge and the image of one frame is formed. The subsequent start in such mode forms frame rotation for the moving image.

All the itemized devices are illustrated below by the following examples that are depicted in the drawings.

DETAILED DESCRIPTION OF THE PREFERRED EMBODIMENT(S)

Figure 1:
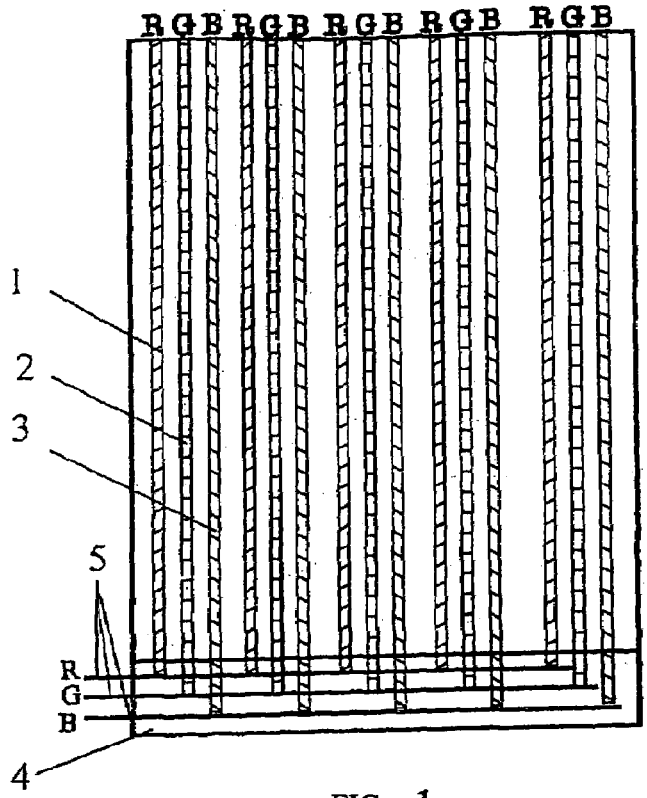
FIG. 1. Constructive version of the display anode as a light-emitting matrix.

On FIG. 1, a constructive version of the display anode with self-scanning rotation as a light-emitting matrix is represented. Here three-color electronic low-voltage phosphors 1, 2, and 3 (500-1500 V) are put on transparent electrodes placed on glass 4. They are managed consistently with the assistance of high-voltage impulses inputted on electrodes 5. These electrodes form red (R), green (G), blue (B) standard signals.

Figure 2:
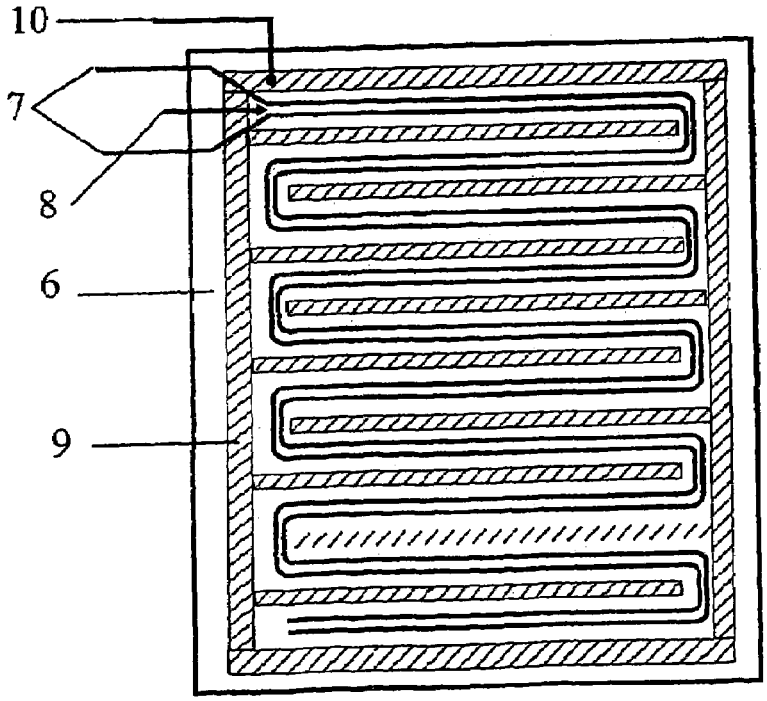
FIG. 2. Constructive version of the display cathode with self-scanning rotation.

On FIG. 2, a constructive version of the display cathode with self-scanning rotation is represented. Here on a glass substrate 6 the zigzag grooves are generated, in which the managing electrodes 7, determining parameters of soliton movement in nanostructured active material are placed. This material has high ability of cold emission of electrons in vacuum due to coherent electronic effects. A managing electrode 8 is placed on the nanostructured active material which forms soliton of the given size in necessary time in the input of a line. Oon electrodes 7, 8 impulse voltages with given amplitudes and duration are applied to form electronic soliton, which moves with identical speed on the serpentine. In the end of the serpentine it breaks. The common time of pass of soliton determines time of the frame.

Then the reverse voltage are applied on electrodes 7, which restores the nanostructured active material. After that the start of the following frame is carried out. The additional electrode as a grid 9 is put on a substrate 6. Upon applying on an input electrode of a grid 10 positive voltage relatively to electrodes 7, part of electrons, included in the soliton structure, will emission for vacuum and will come on the anode, positive potential, greater than potential of a grid, is applied to the anode. Generated on the anode R, G, B phosphors should transverse to serpentine. The position of electrodes on FIG. 1 is put on electrodes as shown in FIG. 2. The fragment of such superposition is shown on FIG. 3.

Figure 3:
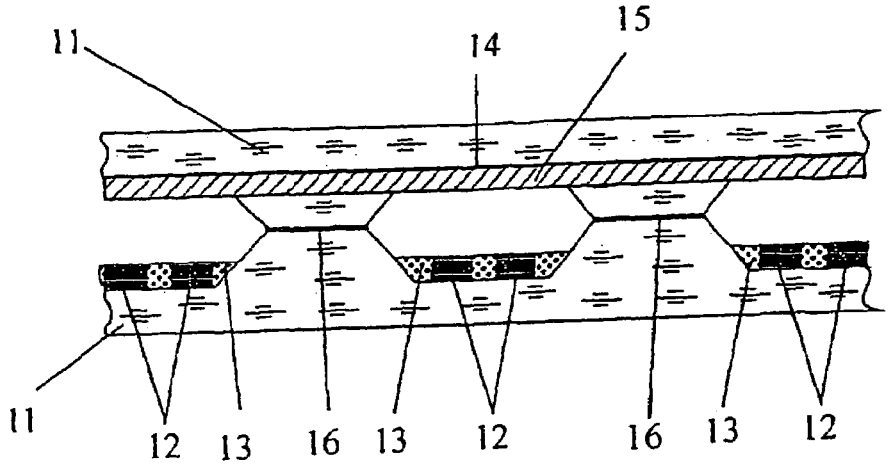
FIG. 3. Constructive variant of a segment of the display in assembly.

On FIG. 3, a constructive variant of a segment of the display in assembly is represented. The grooves are formed on glass substrates 11. The corresponding elements are put in these grooves. The management electrodes 12 placed on glass substrate 11 determine character of soliton movement. Nanostructured active material 13 is placed on glass substrate 11. Phosphor 15 is put on the transparent conducting anode 14. The additional electrode in the form of a metal grid 16 settles between the anode and cathode.

Figure 4:
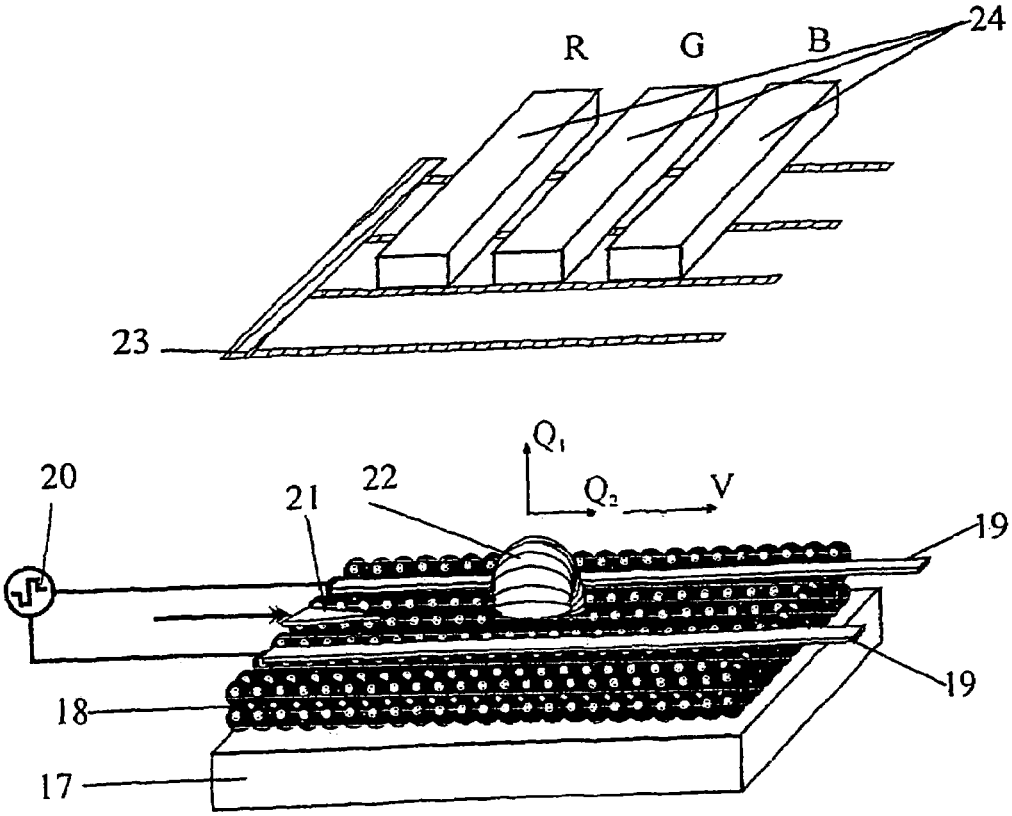
FIG. 4. Movement of the electronic soliton in the display.

On FIG. 4, the movement of the electronic soliton in the display is shown. Glass substrate 17, nanostructured active material 18, and management electrodes 19 determine parameters of the soliton movement. Generator 20 manages impulses of soliton movement which form the frame image. Managing electrode 21 forming soliton given size in necessary time. Electronic soliton 22 in the form of tore has a charge Q1. The soliton moves along electrodes 19 on a groove with the velocity $v \leqq 2*10^5$ m/s. A part of the charge Q1 soliton emits in vacuum in the direction of a grid 23. On transparent electrodes of the anode are located R, G, B phosphors 24. The charge Q1, emitting from the soliton, passing by a grid 23, gets on the corresponding phosphor. Impulse potentials on electrodes 23 and phosphors 24 determine brightness and color of the image at each moment of time of the soliton movement. Thus it is formed colorful brightness picture of the frame.

EMBODIMENT OF THE INVENTION

The disclosed invention provides the opportunity of creation of low-cost flat displays of a large-size format with a reduced level of electromagnetic fields and high frame rotation frequency.

However, the problem is whether it is possible to use modern techniques for producing the proposed displays and whether the mass-produced devices are economical.

There are presently two approaches to manufacturing FPD: lithographic and printographic. The former, based on photoprinting, is a high-precision process involving numerous technological operations. The latter, the way it's being used now, is less precise as based on the pattern printing technique. The low accuracy of the pattern printing technique makes successive application of the pattern layers increasingly more difficult resulting in a higher error ratio.

The disclosed invention is designed for maximal use of technological operations and process equipments used in the manufacture of PDP of panels. Further is planned to improve these technologies with the purpose of reducing the cost price by mass manufacture.

The greatest problem will be made by formation of nanostructured films in the grooves of a glass. For this purpose through open windows of masks is made film evaporation from clusters or clusters precipitation from a liquid phase. Besides through an open mask in a groove it is possible to put metal, in which then are formed nanochannel or nanoporous with the help of anodization.

Consider the ways of nanoparticles forming as described below. There are two methods of forming spherical and sphere-like particles [8]. The first method—metal or semiconductor clusters of a diameter up to 37 nm are formed of a gas phase with their further oxidation in the oxygen flow or similar chemicals. Formation of such particles is similar to formation of hail in the Earth's atmosphere. The second method is the colloidal method. It is based on cluster precipitation from metal salt solutions followed by chemical coating with corresponding enclosures.

Nanosized hollow spheres of zirconium dioxide are automatically obtained during the process of high-frequency plasma-chemical denitrification; therefore they may be applied to the substrate directly from plasma [9]. Or, for example, 4-15 nm particles result automatically in material $Mo_2N$ [10].

Designing planar vertical nanochannels is based on collective formation methods, e.g., according to electrochemical oxidation Al, Ta, Nb, Hf, etc. The formed channel may be filled with metal or semiconductor by the galvanic technique [11].

It is possible to use more simple technology of reception nanostructured material, for example, on the basis of creating nanoporous foam. For this purpose it is possible to finish technology of creation of carbon foam or technology of synthesis nanoporous silicate glasses [12]. Besides the low-cost way of synthesis of spherical porous particles on sol-gel method will allow also to generate nanostructured material for the condenser [13].

The aforementioned examples show that the modern techniques allow producing nanostructured materials for the cathode of the display on the basis of existing technologies.

INFORMATION SOURCES

1. Display Systems Design and Applications., L. W. Mackdonald and A. C. Lowe, WILEY STD 1977
2. U.S. Pat. No. 5,018,180
3. Mesyats G. A., Ecton—avalanche of electrons from metal. UFN, No 6, 1995
4. "Quantum-Size Electronic Devices and Operating Conditions Thereof" (International Publication Number: WO 00/41247, Jul. 13, 2000)
5. Kapitonov A. N. et. al., Relativistic equilibrium of toroidal medium in eigenfield. Preprint MIFI, 1987.
6. Buzaneva E. V. Microstructures of integral electronics. M. Radio. 1990.
7. Modinos A., Auto- thermo- and secondary emission spectroscopy. M. Nauka 1990.
8. Petrov U. I. Cluster and minor particles. M. Nauka. 1986, 368 pp. (In Russian)
9. Dedov N. V. et al., Structural studies of powders on basis of zirconium dioxide produced by HF-plasmachemical denitration method. Glass and Ceramics. 1991. No. 10, p. 17-19 J. Phys. Chem. 18. ?15. 1994. P. 4083.
10. Averjanov E. E. Anodization hand-book. M. Mashinostroenie. 1988.
11. U.S. Pat. No. 5,300,272
12. Anal. Sci. 10. No. 5. 1994. P. 737.

What is claimed is:

1. A self-scanning flat two-coordinate display, comprising a light active matrix in the form of a set of periodic lines having light-reflecting, light-transparent, or light-emitting elements, which are controlled by current or a charge generated by a scan raster device, wherein the raster device is made in the form of streamers in the form of a serpentine row produced from nanostructured active material, in which there is induced and propagates a running electronic wave which controls the light active matrix.

2. The display according to claim 1, wherein the raster device is made in the form of a matrix from the isolated streamers, overcoated by the lines in grooves on a surface of a dielectric, with a step determined required resolution.

3. The display according to claim 1, wherein the raster device is made in the form of the serpentine row produced from the nanostructured active material overcoated in a serpentine groove on a surface of a dielectric, with a step determined required resolution.

4. The display according to claim 2 wherein on each streamer at least two control electrodes for determining parameters of soliton movement are overcoated.

5. The display according to claim 2 wherein an undamped wave is established in the beginning of each streamer and includes at least one managing electrode for forming the undamped wave of a given size.

6. The display according to claim 1, wherein between the raster device and the light active matrix isolated from them, is formed at least one additional managing electrode, produced in the form of a grid, carrying out modulation of an electronic flow for formation of an image having a brightness.

7. A self-scanning flat two-coordinate display, comprising:

a light active matrix in the form of a set of periodic lines having light-reflecting, light-transparent, or light-emitting elements, which are controlled by current or a charge generated by a scan raster device, wherein the raster device is made from streamers produced from nanostructured active material, in which there is induced and propagates a running electronic wave which controls the light active matrix;

wherein the raster device is made in the form of a matrix from the isolated streamers, overcoated by the lines in grooves on a surface of a dielectric, with a step determined required resolution;

wherein at least two control electrodes for determining parameters of soliton movement are overcoated on each streamer;

wherein the nanostructured active material includes clusters with tunnel-transparent gaps, wherein the clusters have at least one distinguished cross-sectional size determined within the range $7.2517\ nm \leqq r \leqq 29.0068\ nm$, the thickness of the tunnel-transparent gap being not more than 7.2517 nm, the spacing between the electrodes being more than 7.2517 nm.

8. The display according to claim 7, wherein the clusters are made of material selected from the group of substances—semiconductor, conductor, superconductor, high molecular organic substance or their combination.

9. The display according to claim 7, wherein the clusters are made in the form of a cavity having a tunnel-transparent layer shell, consisting of the semiconductor or dielectric.

10. The display according to claim 7, wherein the clusters have centrally symmetric form.

11. The display according to claim 7, wherein the clusters are made extended and have a distinguished cross-sectional size determined within the range $14.5034\ nm \leqq r \leqq 29.0068\ nm$.

12. The display according to claim 11, wherein the clusters are made extended along an axis and have a periodic structure with the period determined within the range $7.2517\ nm \leqq r \leqq 29.0068\ nm$.

13. The display according to claim 7, wherein a plurality of clusters are periodically located at least in one layer, the intervals between the clusters being tunnel-transparent not exceeding 7.2517 nm.

14. The display according to claim 7, wherein a plurality of clusters with tunnel-transparent gaps are periodically located as layers, at least, in one of layers the parameters of the clusters differ from the parameters of the clusters in the next layers, the intervals between the clusters being tunnel-transparent not exceeding 7.2517 nm.

15. The display according to claim 7, wherein a plurality of clusters are made in the form of a cavity having a tunnel-transparent layer shell, contact at least in two points of a cavity with the next clusters, forming the material similar to foam with open pores, the shell is made from either semiconductor, dielectric, or high molecular organic substance, and the pores are filled either with gas, semiconductor, or dielectric, with properties differing from properties of the material of the shell.

16. A process for operating the display according to claim 7, the process comprising transmitting an electric field in working range of field strength, wherein the field strength on one cluster for work of the raster device is at least $E_{min}=m_e^2\alpha^5c^3/2e\hbar=1.37*10^5$ V/cm, the maximal field strength is less than $3E_{min}$.

17. A process for operating a self-scanning flat two-coordinate display comprising a light active matrix in the form of a set of periodic lines having light-reflecting. light-transparent, or light-emitting elements, which are controlled by current or a charge generated by a scan raster device made in the form of streamers produced from nanostructured active material in which there is induced and propagates a running electronic wave which controls the light active matrix, the process comprising restriction of limiting working current density of the raster device by the value $j_e=8\pi em_e^3\alpha^8c^4/h^3=6.8*10^4$ A/cm$^2$.

18. A process for operating the display according to claim 1, the process comprising for formation of one picture area is necessary to give at least one managing impulse on an electrode of soliton formation and at least one more managing impulse on each electrode, managing soliton movement along lines.

19. The process for operating the display according to claim 18, wherein after ending of soliton movement on a line, on each electrode of soliton formation is given at least one impulse for regeneration nanostructured active material—is made ready it for next picture area.

20. A process for operating the display according to claim 6, wherein on an at least one additional managing electrode made as a grid, is given a impulse voltage, sufficient for extracting of electrons in vacuum or on rarefied gaseous medium from the nanostructured active material, and the amplitude of a managing impulse is proportional to brightness of the image in the given point at the moment of passage of soliton at this time, in that way spatial time modulation of brightness is carried out due to management of a current or charge.

* * * * *